US005324609A

United States Patent [19]

Yagi et al.

[11] Patent Number: 5,324,609

[45] Date of Patent: Jun. 28, 1994

[54] PHOTORECEPTOR WITH POLYMER OVERLAYER HAVING SILOXANE AND IMIDE MOIETIES

[75] Inventors: Shigeru Yagi; Yuzuru Fukuda; Masato Ono; Masaki Yokoi; Masao Watanabe; Taketoshi Higashi, all of Minami ashigara, Japan

[73] Assignee: Fuji Xerox Co., Ltd., Minato, Japan

[21] Appl. No.: 899,841

[22] Filed: Jun. 17, 1992

[30] Foreign Application Priority Data

Jun. 21, 1991 [JP] Japan ..... 3-175790

[51] Int. Cl.[5] ..... G03G 5/147

[52] U.S. Cl. ..... 430/66; 430/58; 430/59; 430/67

[58] Field of Search ..... 430/56, 58, 59, 66, 430/67, 96

[56] References Cited

FOREIGN PATENT DOCUMENTS 2-111962 4/1990 Japan .

OTHER PUBLICATIONS

L. P. Harasta, et al., "Radiation-curable overcoat compositions" *Research Disclosure,* May 1983 pp. 188-190.

*Primary Examiner*—Roland Martin

*Attorney, Agent, or Firm*—Oliff & Berridge

[57] ABSTRACT

An electrophotographic photoreceptor comprising a conductive substrate, a photoconductive layer formed on the substrate, and a surface layer formed on the photoconductive layer, wherein the surface layer comprises a polymer mainly composed of a siloxane bond and an imide bond. The photoreceptor has small dark decay and excellent mechanical strength and causes no image blurring under high humidity conditions and therefore can be used in a general electrophotographic process. When used in a laser printer using a coherent light source, the photoreceptor produces high quality images free from a Moiré fringe.

9 Claims, 1 Drawing Sheet

PHOTORECEPTOR WITH POLYMER OVERLAYER HAVING SILOXANE AND IMIDE MOIETIES

FIELD OF THE INVENTION

The present invention relates to an electrophotographic photoreceptor and, more particularly to an electrophotographic photoreceptor comprising an amorphous silicon used as a photosensitive layer.

BACKGROUND OF THE INVENTION

Amorphous silicon (hydrogenated amorphous silicon) is a recently developed material for making a photosensitive layer of an electrophotographic photoreceptor, and various improvements have been attained. A photoreceptor using amorphous silicon is usually prepared by forming an amorphous silicon film on a conductive substrate by glow discharge decomposition of silane gas ($SiH_4$). The thus formed amorphous silicon film contains a hydrogen atom and exhibits satisfactory photoconductivity. The amorphous silicon photoreceptor exhibits various advantages, such as excellent wear resistance due to the high surface hardness of the photosensitive layer, high heat resistance, electrical stability, broad spectral sensitivity, and high photosensitivity, which are ideal properties needed for an electrophotographic photoreceptor.

Notwithstanding these excellent properties, an amorphous silicon photoreceptor undergoes a large dark decay due to its relatively low dark resistance. This leads to a disadvantage in that a sufficient potential cannot be obtained on charging. That is, when a charged amorphous silicon photoreceptor is imagewise exposed to light to form an electrostatic latent image and then the latent image is developed, the surface potential of the photoreceptor decays by the time of the exposure, or the charges on the non-exposed area also decay by the time to the development, resulting in a failure of keep the potential necessary for development.

The potential decay is dependent on environmental conditions and becomes conspicuous particularly under high temperature and high humidity conditions. Besides, the initial surface potential attained gradually decreases on repeated use. Such an electrophotographic photoreceptor undergoing great dark decay only produces copies having a low image density and poor reproducibility of halftone.

In order to overcome this problem, it has been proposed to form a charge blocking layer (charge injection preventing layer) comprising amorphous silicon carbide, amorphous silicon nitride, amorphous silicon oxide, etc. by plasma CVD (chemical vapor deposition) on the amorphous silicon photoconductive layer. The charge blocking layer also serves as a surface protective layer.

However, an amorphous silicon photoreceptor having such a surface layer causes image smearing or blur on repeated use, particularly under high humidity conditions, and it cannot be used in an ordinary electrophotographic process.

JP-A-2-111962 (the term "JP-A" as used herein means an "unexamined published Japanese patent application") teaches formation of a surface protective and lubricating layer mainly composed of an organic binder resin, but the proposed surface layer is too thin (10 to 300 nm) for practical use.

Further, amorphous silicon formed by plasma CVD, though having high surface hardness, is less resistant against impact and is broken more easily than a selenium photoconductive layer or an organic photoreceptor. Therefore, a photoreceptor mainly composed of amorphous silicon is likely to suffer from scratches on contact with a paper stripping click, etc., and the scratches develop white spots or black spots on reproduced images.

Furthermore, an amorphous silicon photoreceptor generally has many hemispherical defects of 1 to 30 $\mu$m in diameter on its surface. On repeated use, electrical or mechanical destruction occurs at the film defects causing white spots or black spots to develop on reproduced images.

SUMMARY OF THE INVENTION

An object of the present invention is to eliminate the above-described disadvantages associated with an amorphous silicon photoreceptor.

Another object of the present invention is to provide an electrophotographic photoreceptor having a small dark decay.

A further object of the present invention is to provide an electrophotographic photoreceptor which is excellent in mechanical strength and causes no image defects.

A still further object of the present invention is to provide an electrophotographic photoreceptor which causes no blur under high humidity conditions and is applicable to a general electrophotographic process.

A still further object of the present invention is to provide an electrophotographic photoreceptor which provides an image free from a Moiré fringe even on a laser printer using a coherent light beam.

As a result of extensive investigations, the inventors of the present invention have found that when an amorphous film mainly comprising silicon, nitrogen, and carbon formed by plasma CVD is present on the surface of a photoreceptor, it is more susceptible to oxidation than other substances although it is thermally and mechanically stable and that the oxidized surface of the film is more active than an organic or inorganic high polymeric film with respect to adsorption of moisture or corotron products. It has also been found that destruction at film defects, which has been considered decisive on the life of an amorphous silicon photoreceptor, can be prevented by scattering the ionic stream from a corotron to avoid concentration on the film defects. The present invention has been completed based on these findings.

The present invention provides an electrophotographic photoreceptor comprising a conductive substrate, a photoconductive layer formed on the substrate, and a surface layer formed on the photoconductive layer, the surface layer comprising a polymer mainly composed of a siloxane bond and an imide bond.

In a preferred embodiment, the photoconductive layer is mainly composed of amorphous silicon containing a hydrogen atom and/or a halogen atom.

The electrophotographic photoreceptor according to the present invention has improved chemical stability, improved mechanical strength, and improved electrical stability while maintaining the characteristics of conventional photoreceptors. Additionally, the photoreceptor of the present invention does not cause image defects even in using coherent light.

BRIEF DESCRIPTION OF THE ACCOMPANYING DRAWINGS

DETAILED DESCRIPTION OF THE INVENTION

Figure 1:
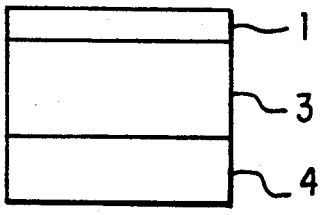
FIGS. 1A, 1B and 1C show a schematic cross section of the electrophotographic photoreceptors according to the present invention.
Figure 1:
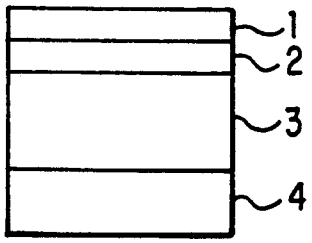
Figure 1:
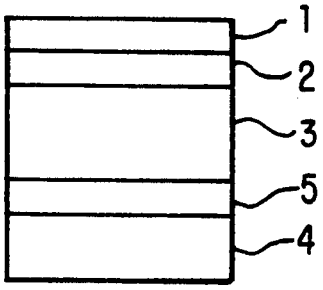

The electrophotographic photoreceptor of the present invention may have any of the layer structures shown in FIG. 1. FIG. 1-(*a*) depicts an embodiment of a typical layer structure comprising conductive substrate 4, photoconductive layer 3, and surface layer 1 made of a polymer mainly composed of a siloxane bond and an imide bond. In other embodiments shown in FIGS. 1-(*b*) and (*c*), intermediate layer 2 or intermediate layers 2 and 5 for adhesion improvement or for charge blocking are provided between photoconductive layer 3 and surface layer 1 or between photoconductive layer 3 and surface layer 1 and between photoconductive layer 3 and conductive substrate 4.

The conductive substrate which can be used in the present invention may be made of a conductive material, such as metals ( e.g., aluminum, stainless steel, nickel, chromium) or alloys thereof, and intermetallic compounds (e.g., $In_2O_3$, $SnO_2$, CuI, $CrO_2$); or an insulating material, such as synthetic resins (e.g., polyester, polyethylene, polycarbonate, polystyrene, polyamide, polyimide), glass, and ceramics. In using an insulating material, the surface thereof, at least on the side on which a photoconductive layer or an intermediate layer is to be laminated, must be rendered electrically conductive by, for example, depositing the above-described metal or, in addition, gold, silver, copper, etc. by vacuum evaporation, sputtering, or ionic plating.

Irradiation of an electromagnetic wave may be conducted either from the side of a conductive substrate or from the opposite side. In the former case, the conductive substrate must be made of a material capable of transmitting an electromagnetic wave. For example, a substrate with a metal deposit should have the deposit thickness controlled so as to transmit an electromagnetic wave. A transparent conductive film made, e.g., of indium-tin oxide, may also be utilized.

The conductive substrate may have any shape, e.g., a cylindrical shape or an endless belt shape.

The photoconductive layer which can be used in the present invention includes an organic photoconductive layer comprising a binder resin (e.g., polyester, polycarbonate, polystyrene) having dispersed therein a charge generating material, such as chalcogenide compounds (e.g., Se, SeTe, SeAs), phthalocyanine compounds, azo compounds, and squarylium compounds, and a charge transporting material, such as pyrazoline compounds and triphenylamine compounds; and an inorganic photoconductive layer mainly comprising amorphous silicon. The amorphous silicon photoconductive layer, particularly a layer comprising amorphous silicon containing a hydrogen atom and/or a halogen atom, is preferred in view of the greater effects exerted by the surface layer according to the present invention.

The photoconductive layer may have a single layer structure or a laminate structure comprising a charge generating layer and a charge transporting layer.

The present invention will hereinafter be described in detail by referring to the embodiments in which the photoconductive layer comprises amorphous silicon.

A photoconductive layer mainly composed of amorphous silicon can be formed on a conductive substrate by glow discharge, sputtering, ionic plating, vacuum evaporation, or the like film forming techniques. In particular, a plasma CVD method consisting of glow discharge decomposition of silane gases (e.g., $SiH_4$) can produce a photoconductive layer including an adequate amount of hydrogen, which layer exhibits optimum characteristics for use in electrophotographic photoreceptors, such as relatively high dark resistance and high photosensitivity. In carrying out plasma CVD, hydrogen gas may be fed together with a silane gas into a plasma CVD apparatus to increase the efficiency of hydrogen inclusion.

Examples of gases useful as a starting material to form amorphous silicon include silane gases, e.g., $SiH_4$, $Si_2H_6$, $Si_3H_8$, and $Si_4H_{10}$; and halogenosilane gases, e.g., $SiCl_4$, $SiF_4$, $SiHF_3$, $SiH_2F_2$, and $SiH_3F$.

If desired, the amorphous silicon photoconductive layer may further contain elements other than hydrogen and halogen atoms. For example, for the purpose of controlling dark resistance or charging polarity of the photoconductive layer, a dopant gas may be added to the starting material gas to dope the photoconductive layer with impurity elements belonging to Group III or Group V, e.g., boron or phosphorus. Examples of useful dopant gases include $B_2H_6$, $B_4H_{10}$, $BF_3$, $BCl_3$, $PH_3$, $P_2H_4$, $PF_3$, and $PCl_3$.

The photosensitive layer may further contain a carbon atom, an oxygen atom, or a nitrogen atom for the purpose of increasing dark resistance, photosensitivity or chargeability (charging capacity or charge potential per unit film thickness).

The photosensitive layer may furthermore contain germanium for the purpose of increasing sensitivity in the long wavelength region. Examples of germanium sources include $GeH_4$, $Ge_2H_6$, $Ge_3H_8$, $Ge_4H_{10}$, $Ge_5H_{12}$, and $GeF_4$.

Incorporation of these various elements other than hydrogen into an amorphous silicon photoconductive layer can be achieved by introducing a silane gas as a main starting material together with a gaseous substance containing the desired element into a plasma CVD apparatus to conduct glow discharge decomposition.

Conditions of glow discharge decomposition using, for instance, an alternating current are generally from 0.1 to 30 MHz, and preferably from 5 to 20 MHz, in frequency; from 0.1 to 5 Torr (13.3 to 66.7 $N/m^2$) in degree of vacuum on discharge; and from 100° to 400° C., in substrate temperature.

The thickness of the amorphous silicon photoconductive layer is arbitrary but usually selected from 1 to 200 μm, and preferably from 10 to 100 μm.

If desired, the electrophotographic photoreceptor according to the present invention may further comprise an intermediate layer formed between the photoconductive layer and the conductive substrate as shown in FIG. 1-(*c*). The intermediate layer includes an insulating layer made of, for example, P-type or N-type amorphous silicon heavily doped with a Group III element or Group V element, respectively, according to the charging polarity of the photoreceptor, or $SIN_x$, $SiO_x$, or $SiC_x$.

The insulating layer can be formed in the same manner as for the above-described photoconductive layer. The insulating layer preferably has a thickness of from 0.3 to 10 μm .

The surface layer of the electrophotographic photoreceptor according to the present invention comprises a polymer mainly composed of a siloxane bond and an imide bond or, in a preferred embodiment, the polymer having dispersed therein a conductive metal oxide fine powder.

The polymer which can be used in the surface layer may be obtained by heat curing an amide acid mainly composed of siloxane which is characterized by its infrared absorption spectrum showing an absorption at around 1680 to 1700 $cm^{-1}$ which is assigned to an imide group and an absorption at around 1100 $cm^{-1}$ which is assigned to a siloxane bond.

The amide acid mainly composed of siloxane which can be used in the present invention preferably includes those represented by formula (I):

(I)

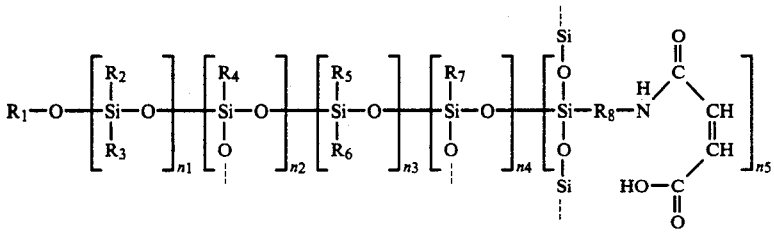

wherein $R_1$, $R_2$, $R_3$, and $R_4$ each represent an alkyl group having from 1 to 5 carbon atoms; $R_5$, $R_6$, and $R_7$ each represent an aryl group having from 6 to 18 carbon atoms; $R_8$ represents an alkylene group having from 1 to 5 carbon atoms; $n_1$, $n_3$, and $n_5$ each represent an integer of from 1 to 100; and $n_2$ and $n_4$ each represent an integer of from 0 to 100.

The above-described amide acid mainly composed of siloxane can be obtained by hydrolyzing an alkoxysilane compound and an amide-containing alkoxysilane compound. The starting alkoxysilane compound includes bifunctional, trifunctional, or tetrafunctional alkoxysilane compounds having a methyl group, an ethyl group, a propyl group, an isopropyl group, a phenyl group, a methoxy group, an ethoxy group, etc. as functional groups. The alkoxysilane compound to be used is selected appropriately from the standpoint of desired characteristics of the cured film, such as hardness, adhesion, flexibility, and weather resistance.

The surface layer can be formed by coating a coating composition on a photoconductive layer or an intermediate layer by spray coating or dip coating, and then curing the coating at a temperature of from 100° to 300° C. for a period of from 1 to 24 hours. The coating composition can be obtained by dissolving the above-mentioned amide acid in a solvent with its viscosity being adjusted.

As stated above, the polymer to be coated may have dispersed therein a conductive metal oxide fine powder by means of a ball mill, a sand mill, or an attritor. The conductive metal oxide fine powder preferably has an average particle size of not more than 0.3 μm , and more preferably from 0.05 to 0.3 μm . It should be noted that the conductive metal oxide fine powder to be added must not cause coloring of the resulting surface layer which may adversely affect the spectral sensitivity of the photoreceptor. Examples of usable conductive metal oxides include zinc oxide, titanium oxide, tin oxide, antimony oxide, indium oxide, bismuth oxide, tin-doped indium oxide, antimony-doped tin oxide, and zirconium oxide. These metal oxide fine powders may be used either singly or in combinations of two or more thereof. A combination of two or more of these powders may be used in the form of a solid solution or a fused solid.

The thickness of the surface layer is not particularly limited but should be selected so as to have sufficient mechanical strength for enabling a Carlson system. In general, the thickness is not more than 20 μm , and preferably from 0.1 to 10 μm . If it is greater than 20 μm , the residual potential after exposure is too high. If it is less than 0.1 μm , the characteristics of amorphous silicon photoreceptors cannot be manifested due to lack of mechanical strength.

The surface layer serves not only as a charge blocking layer for inhibiting charge injection from the surface portion of a photoconductive layer to the inside during a charging process but also as a surface protective layer for preventing oxidizing molecules commonly present in the environment, such as oxygen, steam, moisture and ozone ($O_3$), from directly contacting with or being adsorbed onto the surface of the photoconductive layer. The surface layer also functions to protect the photoconductive layer against external factors, such as application of stresses and adhesion of reactive chemical substances thereby preventing destruction of the characteristics of the photoconductive layer.

The electrophotographic photoreceptor according to the present invention is used in a so-called Carlson system comprising the steps of charging and imagewise exposure. Therefore, the surface layer is required to have low insulating properties or have a controlled thickness so as to prevent accumulation of charges on the surface of the surface layer or in the inside. However, if its conductivity is too high, charge transfer in the transverse direction is likely to occur causing blurring. If its conductivity is too low, charge accumulates causing fogging in images. Therefore, the conductivity of the surface layer should be controlled within an appropriate range. Further, the conductivity should be stable against external influences such as temperature and humidity.

The surface layer used in the present invention which is formed of a polymer mainly composed of a siloxane bond and an imide bond fulfills the above-described functions with a small thickness without causing a reduction in sensitivity or an increase in residual potential. Further, since it has a small refractive index, surface reflection is minimized, and therefore a sensitizing effect is produced where the photoreceptor has a layer having a high refractive index, such as an amorphous silicon layer or a chalcogenide layer. Furthermore, the polymer has a high curing temperature, which is advantageous for forming the surface layer on an amorphous silicon layer.

If desired, an intermediate layer may be provided between the surface layer and the photoconductive layer as shown in FIGS. 1-(*b*) and (*c*). This intermediate layer serves to lessen the influences of surface oxidation on the surface layer and also to block charge injection from the surface layer.

The intermediate layer is preferably composed of at least one layer mainly comprising hydrogen-containing amorphous silicon, amorphous silicon carbide, amorphous silicon nitride, amorphous silicon oxide, or amorphous carbon. The intermediate layer is preferably formed by plasma CVD from the viewpoint of adhesion and productivity.

When the silicon intermediate layer is formed by plasma CVD, starting materials supplying silicon include silane gases, e.g., $SiH_4$, $Si_2H_6$, $Si(CH_3)_4$, $Si_3H_8$, and $Si_4H_{10}$; and halogenosilane gases, e.g., $SiCl_4$, $SiHCl_3$, and $SiH_2Cl_2$.

Starting materials supplying carbon for the formation of an amorphous silicon carbide layer or an amorphous carbon layer include paraffinic hydrocarbons ($C_nH_{2n+2}$), e.g., methane, ethane, propane, butane, and pentane; olefinic hydrocarbons ($C_nH_{2n}$), e.g., ethylene, propylene, butylene, and pentene; acetylenic hydrocarbons ($C_nH_{2n-2}$), e.g., acetylene, allylene, and butyne; alicyclic hydrocarbons, e.g., cyclopropane, cyclobutane, cyclopentane, cyclohexane, cycloheptane, cyclobutyne, cyclopentene, and cyclohexene; and aromatic compounds, e.g., benzene, toluene, xylene, naphthalene, and anthracene. These hydrocarbons may be halogen-substituted hydrocarbons, e.g., carbon tetrachloride, chloroform, carbon tetrafluoride, trifluoromethane, chlorotrifluoromethane, dichlorofluoromethane, bromotrifluoromethane, fluoroethane, and perfluoropropane.

Starting materials supplying nitrogen for the formation of an amorphous silicon nitride layer include nitrogen and nitrogen compounds in a gaseous form or in a form capable of vaporization, such as nitrogen ($N_2$), ammonia ( $NH_3$ ), hydrazine ($H_2NNH_2$), hydrogen azide ($HN_3$) and ammonium azide ($NH_4N_3$).

Starting materials supplying oxygen for the formation of an amorphous silicon oxide include oxygen ($O_2$), ozone ($O_3$), carbon monoxide (CO), carbon dioxide ($CO_2$), nitrogen monoxide (NO), nitrogen dioxide ($NO_2$), nitrogen sesquioxide ($N_2O_3$), dinitrogen tetroxide ($N_2O_4$), nitrogen hemipentoxide ($N_2O_5$), nitrogen trioxide ($NO_3$), tetramethoxysilane ($Si(OCH_3)_4$), and tetraethoxysilane ($Si(OC_2H_5)_4$).

The above-mentioned starting materials may be gaseous, solid or liquid at room temperature. Solid or liquid starting materials are vaporized prior to feeding them into a reaction chamber.

The intermediate layer may have a single layer structure or a laminate structure composed of two or more layers containing different elements. The element distribution in the intermediate layer may be either uniform or non-uniform. In the latter case, the composition may be changed continuously or discontinuously.

Conditions of plasma CVD for the formation of the intermediate layer using, for instance, an alternating current are generally from 0.1 to 30 MHz, and preferably from 5 to 20 MHz, in frequency; from 0.1 to 5 Tort ( 13.3 to 66.7 $N/m^2$) in degree of vacuum on discharge; and from 100° to 400° C., in substrate temperature.

The thickness of the intermediate layer usually ranges from 0.05 to 10 μm , and preferably from 0.1 to 5 μm . If it is less than 0.05 μm , charge blocking properties are reduced. If it exceeds 10 μm , the residual potential increases, or the sensitivity is reduced.

The present invention is now illustrated in greater detail by way of Examples, but it should be understood that the present invention is not limited thereto. In the following Examples all parts and the like are by weight unless otherwise indicated.

EXAMPLE 1

A cylindrical aluminum-substrate was mounted in a capacitance-coupled plasma CVD apparatus, and a mixed gas consisting of silane gas ( $SiH_4$), hydrogen gas, and diborane gas ($B_2H_6$) was introduced into the reaction chamber to conduct glow discharge decomposition under the following conditions to thereby form an about 2 μm thick charge blocking layer on the substrate.

Film Forming Conditions

100% Silane Gas Flow Rate: 100 $cm^3$/min
100 ppm $H_2$-diluted Diborane Gas Flow Rate: 200 $cm^3$/min
Inner Pressure of Reaction Chamber: 0.5 Torr
Discharge Power: 100 W
Discharge Frequency: 13.56 MHz
Substrate Temperature: 250° C.

(In all the examples and comparative examples hereinafter described, the discharge frequency and substrate temperature in plasma CVD were fixed at the above values.)

After completing the formation of the charge blocking layer, the reaction chamber was thoroughly evacuated, and a mixed gas consisting of silane gas ($SiH_4$), hydrogen gas, and diborane gas ($B_2H_6$) was introduced therein to conduct glow discharge decomposition under the following conditions to thereby form an about 20 μm thick photoconductive layer on the charge blocking layer.

Film Forming Conditions:

100% Silane Gas Flow Rate: 200 $cm^3$/min
200% Hydrogen Gas Flow Rate: 180 $cm^3$/min
100 ppm $H_2$-diluted Diborane Gas Flow Rate: 2 $cm^3$/min
Inner Pressure of Reaction Chamber: 1.0 Torr
Discharge Power: 300 W After completing the formation of the photoconductive layer, the reaction chamber was thoroughly evaluated. On the photoconductive layer was then formed an about 0.3 μm thick first intermediate layer by glow discharge decomposition of a mixed gas consisting of silane gas, hydrogen gas, and ammonia gas under the following conditions.

Film Forming Conditions:

100% Silane Gas Flow Rate: 30 $cm^3$/min
100% Hydrogen Gas Flow Rate: 200 $cm^3$/cm
100% Ammonia Gas Flow Rate: 30 $cm^3$/min
Inner Pressure of Reaction Chamber: 0.5 Torr
Discharge Power: 50 W After completing the formation of the first intermediate layer, the reaction chamber was thoroughly evacuated. A mixed gas consisting of silane gas, hydrogen gas, and ammonia gas was then introduced therein to conduct glow discharge decomposition under the following conditions to form an about 0.1 μm thick second intermediate layer on the first intermediate layer.

Film Forming Conditions:

100% Silane Gas Flow Rate: 17 $cm^3$/min
100% Hydrogen Gas Flow Rate: 200 $cm^3$/cm
100% Ammonia Gas Flow Rate: 43 $cm^3$/min
Inner Pressure of Reaction Chamber: 0.5 Torr
Discharge Power: 50 W Finally, a coating composition of an amide acid mainly composed of siloxane represented by the following formula dissolved in methyl cellosolve with its viscosity being adjusted was spray coated on the second intermediate layer and cured at 190° C. for 2 hours to form a surface layer having a thickness of 0.5 μm as measured with a surface roughness meter.

Amide Acid:

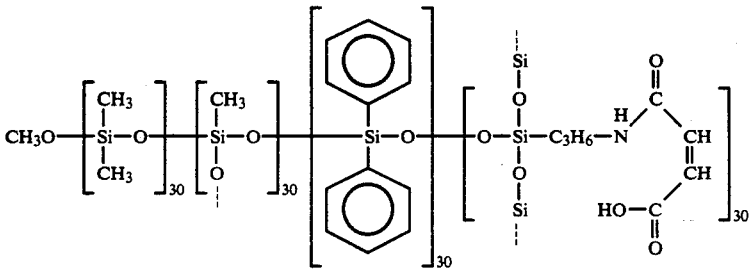

Figure 2:
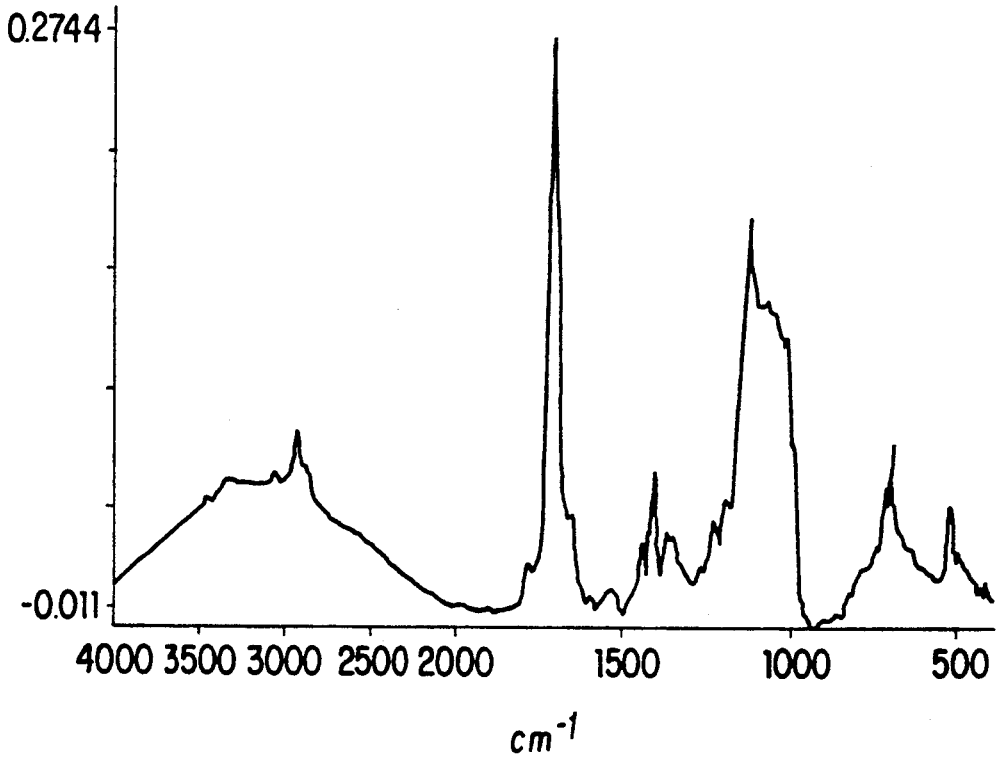
FIG. 2 is an infrared absorption spectrum of the surface layer of the electrophotographic photoreceptor according to the present invention.

The same coating composition for the surface layer was also spray coated on a silicon wafer and cured in the same manner as described above to determine its IR spectrum and Vickers hardness. The IR spectrum is shown in FIG. 2. The spectrum clearly reveals an absorption at 1700 $cm^{-1}$ assigned to an imide bond and an absorption at 1100 $cm^{-1}$ assigned to a siloxane bond. The peak assigned to an imide bond was not observed before the curing reaction. The layer formed on the silicon wafer had a Vickers hardness of 900, which is comparable to the hardness of an amorphous silicon film.

The resulting electrophotographic photoreceptor had a residual potential of 100 V.

The electrophotographic photoreceptor was set in an electrophotographic copying machine ("FX 5990" manufactured by Fuji Zerox Co., Ltd.), and copying was carried out under an environmental condition of 10° C. and 15% RH (relative humidity), 20° C. and 50% RH, or 30° C. and 85% RH.

As a result, copies obtained both in the initial stage and after obtaining 20,000 copies exhibited no blurring under any of the above three environmental conditions. Copying was further continued under the condition of 30° C. and 85% RH to obtain an additional 300,000 copies. As a result, neither blurring nor fogging was observed.

EXAMPLE 2

An amorphous silicon photoreceptor was prepared in the same manner as in Example 1, except that a surface layer was formed as follows.

A coating composition composed of 6 parts of antimony oxide-doped tin oxide powder (antimony oxide content: 15% by weight) having an average particle size of 0.3 μm or less, 14 parts of the same amide acid as used in Example 1, and 80 parts of methyl cellosolve was produced by dispersing the materials in a glass-made ball mill at 15° C. for 50 hours. The coating composition was adjusted in viscosity and spray coated on the second intermediate layer, followed by curing at 190° C. for 2 hours to form a 1 μm thick surface layer.

The IR spectrum determined in the same manner as in Example 1 was substantially equal to that of a film containing no tin oxide/antimony oxide powder, clearly indicating an imide bond at 1700 $cm^{-1}$ and a siloxane bond at 1100 $cm^{-1}$. The Vickers hardness as determined in the same manner as in Example 1 was 500. Further, the polymer film had a contact angle with respect to water of 85°.

The resulting electrophotographic photoreceptor had a residual potential of 50 V.

When the photoreceptor was mounted on a semi-conductor laser printer ("XP-9" manufactured by Fuji Xerox Co., Ltd. ), and printing was carried out, high quality images free from a Moiré fringe were obtained.

The photoreceptor was also evaluated on an electrophotographic copying machine "FX 5990" under the same conditions as in Example 1. As a result, copies obtained both in the initial stage and after obtaining 20,000 copies exhibited no blurring under any of the same three environmental conditions as in Example 1. Copying was further continued under the condition of 30° C. and 85% RH to obtain an additional 300,000 copies. As a result, neither blurring nor fog developed. Further, when solid images were obtained without exposure, there were observed only two white spots of 0.2 mm or smaller on the area corresponding to the entire surface of the photoreceptor.

EXAMPLE 3

An amorphous silicon photoreceptor was prepared in the same manner as in Example 1, except that a surface layer was formed as follows. A coating composition composed of 6 parts of antimony oxide-doped tin oxide powder (antimony oxide content: 15% by weight) having an average particle size of 0.3 μm or less, 14 parts of an amide acid mainly comprising siloxane represented by the formula shown below, and 80 parts of methyl cellosolve was produced by dispersing the materials in a glass-made ball mill at 15° C. for 50 hours. The coating composition was adjusted in viscosity and spray coated on the second intermediate layer, followed by curing at 190° C. for 2 hours to form a 1 μm thick surface layer.

Amide Acid:

-continued

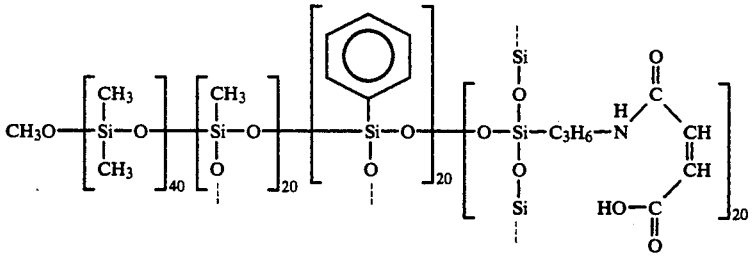

The IR spectrum and rickets hardness were determined in the same manner as in Example 1. The IR spectrum was substantially equal to that of a film containing no tin oxide/antimony oxide powder, clearly indicating an imide bond at 1700 $cm^{-1}$ and a siloxane bond at 1100 $cm^{-1}$. The Vickers hardness was 700. Further, the polymer film had a contact angle with respect to water of 90°.

The resulting electrophotographic photoreceptor had a residual potential of 50 V.

When the photoreceptor was mounted on a semi-conductor laser printer "XP-9", and printing was carried on, high quality images free from a Moiré fringe were obtained.

The photoreceptor was also evaluated on an electrophotographic copying machine "FX 5990" under the same conditions as in Example 1. As a result, copies obtained both in the initial stage and after obtaining 20,000 copies exhibited no blurring under any of the same three environmental conditions as in Example 1. Copying was further continued under the condition of 30° C. and 85% RH to obtain an additional 300,000 copies. As a result, neither blurring nor fogging was observed. Further, when solid images were obtained without exposure, no white spots of 0.2 mm or smaller were observed on the area corresponding to the entire surface of the photoreceptor.

EXAMPLE 4

An amorphous silicon photoreceptor was prepared in the same manner as in Example 3, except that the first and second intermediate layers were replaced with a single intermediate layer formed by plasma CVD under the following conditions.

Film Forming Conditions:

100% Ethylene Gas Flow Rate: 20 sccm

Inner Pressure of Reaction Chamber: 0.5 Torr

Discharge Power: 200 W

The photoreceptor was evaluated on an electrophotographic copying machine "FX 5990" under the same conditions as in Example 1. As a result, copies obtained both in the initial stage and after obtaining 100,000 copies exhibited no blurring under any of the three environmental conditions. Copying was further continued under the condition of 30° C. and 85% RH to obtain an additional 300,000 copies. As a result, neither blurring nor fogging developed.

EXAMPLE 5

An amorphous silicon photoreceptor was prepared in the same manner as in Example 1, except that a surface layer was formed as follows.

A coating composition composed of 6 parts of antimony oxide-doped tin oxide powder (antimony oxide content: 15% by weight) having an average particle size of 0.3 μm or less, 14 parts of an amide acid mainly comprising siloxane represented by the formula shown below, and 80 parts of methyl cellosolve was produced by dispersing the materials in a glass-made ball mill at 15° C. for 50 hours. The coating composition's viscosity was adjusted and it was then spray coated on the second intermediate layer, followed by curing at 190° C. for 2 hours to form a 1 μm thick surface layer.

:Amide Acid:

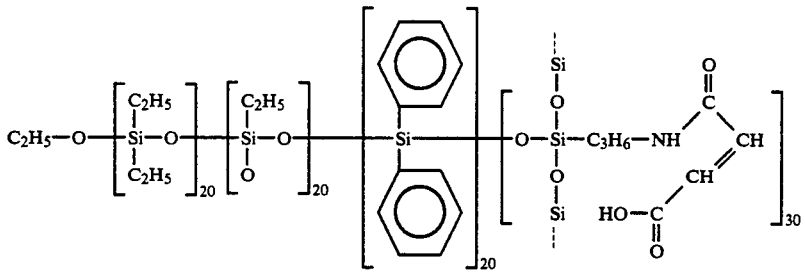

The IR spectrum and Vickers hardness were determined in the same manner as in Example 1. The IR spectrum was substantially equal to that of a film containing no tin oxide/antimony oxide powder, clearly indicating an imide bond at 1700 $cm^{-1}$ and a siloxane bond at 1100 $cm^{-1}$. The rickets hardness was 700. Further, the polymer film had a contact angle with respect to water of 80°.

The resulting electrophotographic photoreceptor had a residual potential of 50 V.

When the photoreceptor was mounted on a semi-conductor laser printer "XP-9", and printing was carried out, high quality images free from a Moiré fringe were obtained.

The photoreceptor was also evaluated on an electrophotographic copying machine "FX 5990" under the same conditions as in Example 1. As a result, copies obtained both in the initial stage and after obtaining 20,000 copies exhibited no blurring under any of the same three environmental conditions as in Example 1.

Copying was further continued under the condition of 30° C. and 85% RH to obtain an additional 300,000 copies. As a result, neither blurring nor fog developed. Further, when solid images were obtained without exposure, there was observed only one white spot of 0.2 mm or smaller on the area corresponding to the entire surface of the photoreceptor.

EXAMPLE 6

An amorphous silicon photoreceptor was prepared in the same manner as in Example 1, except that a surface layer was formed as follows.

A coating composition composed of 6 parts of antimony oxide-doped tin oxide powder (antimony oxide content: 15% by weight) having an average particle size of 0.3 μm or less, 14 parts of an amide acid mainly comprising siloxane represented by the formula shown below, and 80 parts of methyl cellosolve was produced by dispersing the materials in a glass-made ball mill at 15° C. for 50 hours. The coating composition's viscosity was adjusted and it was then spray coated on the second intermediate layer, followed by curing at 190° C. for 2 hours to form a 1 μm thick surface layer.

Amide Acid:

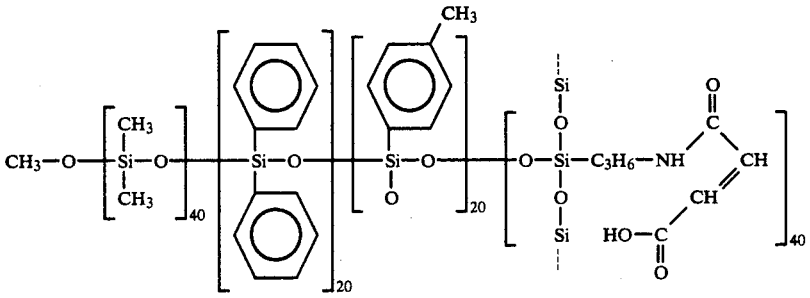

The IR spectrum and Vickers hardness were determined in the same manner as in Example 1. The IR spectrum was substantially equal to that of a film containing no tin oxide/antimony oxide powder, clearly indicating an imide bond at 1700 $cm^{-1}$ and a siloxane bond at 1100 $cm^{-1}$. The rickets hardness was 600. Further, the polymer film had a contact angle with respect to water of 90°.

The resulting electrophotographic photoreceptor had a residual potential of 50 V.

When the photoreceptor was mounted on a semi-conductor laser printer "XP-9", and printing was carried out, high quality images free from a Moiré fringe were obtained.

The photoreceptor was also evaluated on an electrophotographic copying machine "FX 5990" under the same conditions as in Example 1. As a result, copies obtained both in the initial stage and after obtaining 20,000 copies showed no blurrings under any of the same three environmental conditions as in Example 1. Copying was further continued under the condition of 30° C. and 85% RH to obtain an additional 300,000 copies. As a result, neither blurring nor fog developed. Further, when solid images were obtained without exposure, no white spots of 0.2 mm or smaller were observed on the area corresponding to the entire surface of the photoreceptor.

While a conventional amorphous silicon electrophotographic photoreceptor having on the surface thereof a layer mainly composed of amorphous silicon, amorphous silicon nitride, amorphous silicon oxide, or amorphous carbon has various disadvantages as previously stated, the surface layer according to the present invention, which comprises a polymer mainly composed of a siloxane bond and an imide bond, eliminates such disadvantages without impairing the characteristics possessed by an amorphous silicon photoreceptor. The present invention thus provides an electrophotographic photoreceptor which develops no image blurring on long-term use, which has a low residual potential, which is excellent in abrasion resistance and durability, and which causes no image defects, such as white spots, black spots, and white streaks, even on long-term use.

Additionally, the electrophotographic photoreceptor of the present invention can be applied to printers using coherent light, e.g., an infrared semi-conductor laser ray, to obtain high quality images free from an interference fringe called Moiré.

While the invention has been described in detail and with reference to specific examples thereof, it will be apparent to one skilled in the art that various changes and modifications can be made therein without departing from the spirit and scope thereof.

What is claimed is:

1. An electrophotographic photoreceptor comprising a conductive substrate, a photoconductive layer formed on said substrate, and a surface layer formed on said photoconductive layer, said surface layer comprising a polymer mainly composed of a siloxane bond and an imide bond.

2. An electrophotographic photoreceptor as claimed in claim 1, wherein said photoconductive layer comprises amorphous silicon containing a hydrogen atom, a halogen atom, or a hydrogen atom and a halogen atom.

3. An electrophotographic photoreceptor as claimed in claim 1, wherein said surface layer further comprises a conductive metal oxide powder dispersed in said polymer.

4. An electrophotographic photoreceptor as claimed in claim 1, wherein said photoreceptor further comprises an intermediate layer formed between said photoconductive layer and said surface layer.

5. An electrophotographic photoreceptor as claimed in claim 1, wherein said polymer is obtained by curing an amide acid represented by formula (I):

(I)

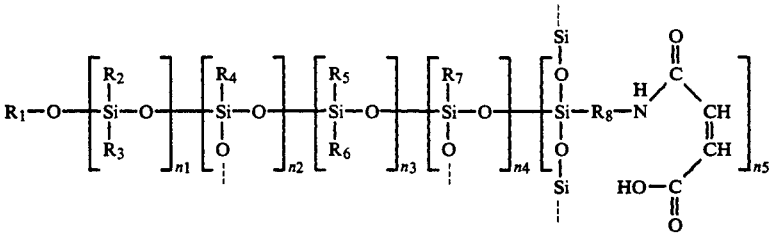

wherein $R_1$, $R_2$, $R_3$, and $R_4$ each represent an alkyl group having from 1 to 5 carbon atoms; $R_5$, $R_6$, and $R_7$ each represent an aryl group having from 6 to 18 carbon atoms; $R_8$ represents an alkylene group having from 1 to 5 carbon atoms; $n_1$, $n_3$, and $n_5$ each represent an integer of from 1 to 100; and $n_2$ and $n_4$ each represent an integer of from 0 to 100.

6. An electrophotographic photoreceptor as claimed in claim 1, wherein said surface layer has a thickness of from about 0.1 μm to about 10 μm.

7. An amorphous silicon electrophotographic photoreceptor comprising a conductive substrate, a photoconductive layer comprising amorphous silicon formed on said substrate, and a surface layer formed on said photoconductive layer, said surface layer comprising a polymer mainly composed of a siloxane bond and an imide bond, said polymer being obtained by curing an amide acid represented by formula (I):

(I)

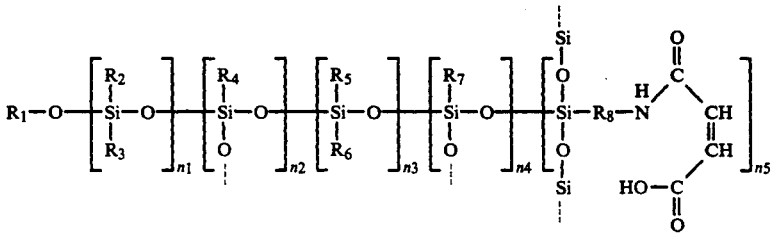

wherein $R_1$, $R_2$, $R_3$ and $R_4$ each represent an alkyl group having from 1 to 5 carbon atoms; $R_5$, $R_6$ and $R_7$ each represent an aryl group having from 6 to 18 carbon atoms; $R_8$ represents an alkylene group having form 1 to 5 carbon atoms; $n_1$, $n_3$ and $n_5$ each represent an integer of from 1 to 100; and $n_2$ and $n_4$ each represent an integer of from 0 to 100.

8. An amorphous silicon electrophotographic photoreceptor as claimed in claim 7, wherein said amorphous silicon contains a hydrogen atom, a halogen atom, or a hydrogen atom and a halogen atom.

9. An amorphous silicon electrophotographic photoreceptor as claimed in claim 7, wherein said surface layer further comprises a conductive metal oxide powder dispersed in said polymer.

* * * * *